US011445812B2

(12) United States Patent
Sager

(10) Patent No.: US 11,445,812 B2
(45) Date of Patent: Sep. 20, 2022

(54) DENTAL APPLIANCE

(71) Applicant: Frederick Sager, Toledo, OH (US)

(72) Inventor: Frederick Sager, Toledo, OH (US)

( * ) Notice: Subject to any disclaimer, the term of this patent is extended or adjusted under 35 U.S.C. 154(b) by 0 days.

(21) Appl. No.: 16/895,121

(22) Filed: Jun. 8, 2020

(65) Prior Publication Data

US 2021/0378393 A1 Dec. 9, 2021

(51) Int. Cl.
*A46B 9/04* (2006.01)
*A46B 9/02* (2006.01)

(52) U.S. Cl.
CPC ..... *A46B 9/04* (2013.01); *A46B 9/028* (2013.01); *A46B 2200/1026* (2013.01); *A46B 2200/1066* (2013.01)

(58) Field of Classification Search
CPC ... A46B 9/04; A46B 9/028; A46B 2200/1026; A46B 2200/1066; A46B 5/016; A46B 15/0055; A46B 15/0069; A46B 15/0071; A46B 15/0081; A46B 15/0087
USPC ..... 15/167.1
See application file for complete search history.

(56) References Cited

U.S. PATENT DOCUMENTS 1,650,200 A * 11/1927 Dougan ..... A46B 15/0075 601/139
1,832,173 A * 11/1931 Yates ..... A46B 15/0071 132/323
2,129,082 A * 9/1938 Byrer ..... A46B 15/00 601/139
5,032,082 A * 7/1991 Herrera ..... A61C 13/24 433/141
6,086,373 A * 7/2000 Schiff ..... A46D 1/00 15/167.1
8,677,545 B2 * 3/2014 Vitt ..... A46B 9/12 15/207.2
2003/0115707 A1 * 6/2003 Buford, III ..... F02M 3/09 15/207.2
2010/0064461 A1 * 3/2010 Almaguer ..... A46D 1/00 15/167.1
2015/0366335 A1 * 12/2015 Rusznak ..... A46B 15/0071 132/309
2017/0007013 A1 * 1/2017 Pariseau ..... A46B 15/0071
2017/0105517 A1 * 4/2017 Petrov ..... A61C 15/046
2019/0357665 A1 * 11/2019 Booker ..... A46B 9/04

FOREIGN PATENT DOCUMENTS

GB 2040160 A * 8/1980 ..... A46B 9/04
WO WO-9804167 A1 * 2/1998 ..... A46D 1/00

* cited by examiner

*Primary Examiner* — Orlando E Aviles
*Assistant Examiner* — Jacob Adam Montgomery
(74) *Attorney, Agent, or Firm* — Schaffer, Schaub & Marriott, Ltd.

(57) ABSTRACT

A dental appliance for removing material from the mouth of a user is disclosed. The appliance has a body with a plurality of bores extending through the body. A cleaning element is positioned in each of the bores. The cleaning elements are disposed to extend beyond the body and are moveably positioned in the bores.

1 Claim, 4 Drawing Sheets

DENTAL APPLIANCE

BACKGROUND OF THE INVENTION

The present invention is directed to a dental appliance that can be utilized to remove material, such as dental adhesive, from the mouth of a user. A significant portion of the population has one or more denture type of dental appliances that are held in place by dental adhesive. The dental appliances are designed to be removed on a fairly frequent basis for cleaning and to renew the dental adhesive that hold the appliances in place. The dental adhesive is very effective at securing the denture appliance to the gums of the user. Unfortunately, when the denture appliance is removed a portion of the dental adhesive remains on the gums of the person with the denture appliance. It is desirable to remove as much of the dental adhesive as possible to clean the users mouth and to reduce possible irritation from the adhesive. As the dental adhesive is designed to secure the denture appliance in the mouth, the dental adhesive bonds to the gums and is difficult to remove. People that wear denture appliances have had to resort to using their fingers or a tooth brush in an attempt to remove the dental adhesive from their mouth. The bristles on a tooth brush are not stiff enough to effectively remove the dental adhesive which results in a less than satisfactory cleaning of the gums. Similar problems exist with the use of the persons fingers as the skin of the fingers tends to slide over the dental adhesive and it is also difficult to remove the dental adhesive from confined areas as the fingers are too large to reach the desired locations. This has resulted in a problem for denture wearers as they have difficulty in properly removing the denture adhesive from their mouths. Accordingly, there is a need for a dental appliance that can effectively be utilized to remove dental adhesive from the mouths of denture wearers.

SUMMARY OF THE INVENTION

A dental appliance for removing material from the mouth of a user is disclosed. The appliance has a body with a plurality of bores extending through the body. A cleaning element is positioned in each of the bores. The cleaning elements are disposed to extend beyond the body and are moveably positioned in the bores.

DETAILED DESCRIPTION OF THE INVENTION

Figure 1:
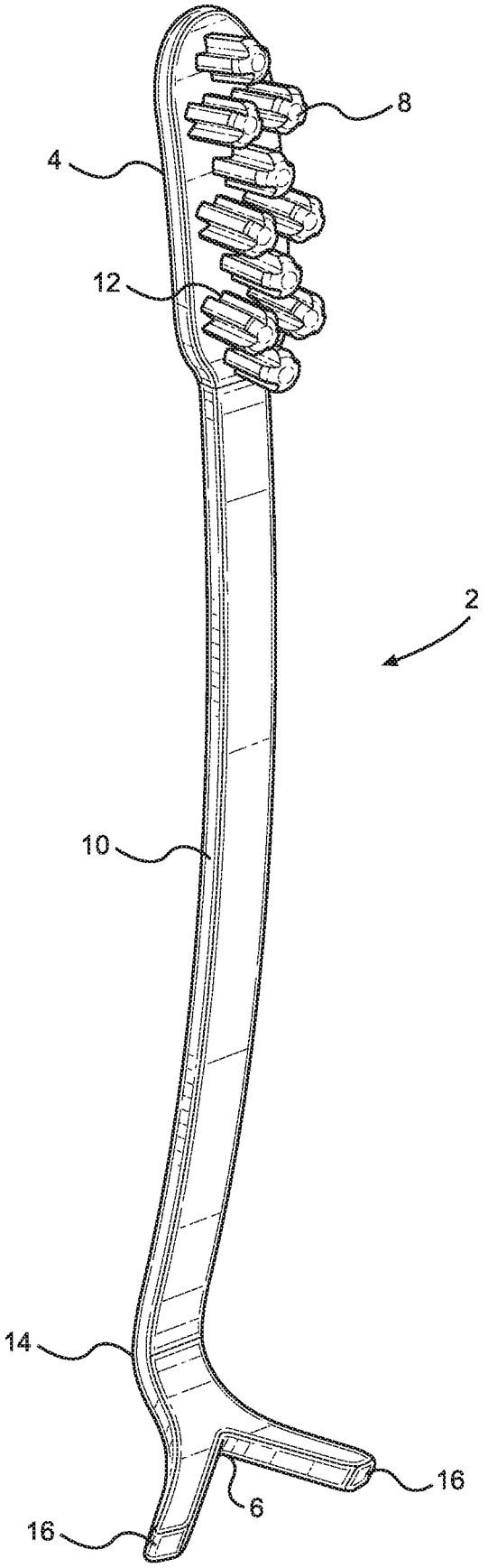
FIG. 1 is a perspective view of the dental appliance.
Figure 2:
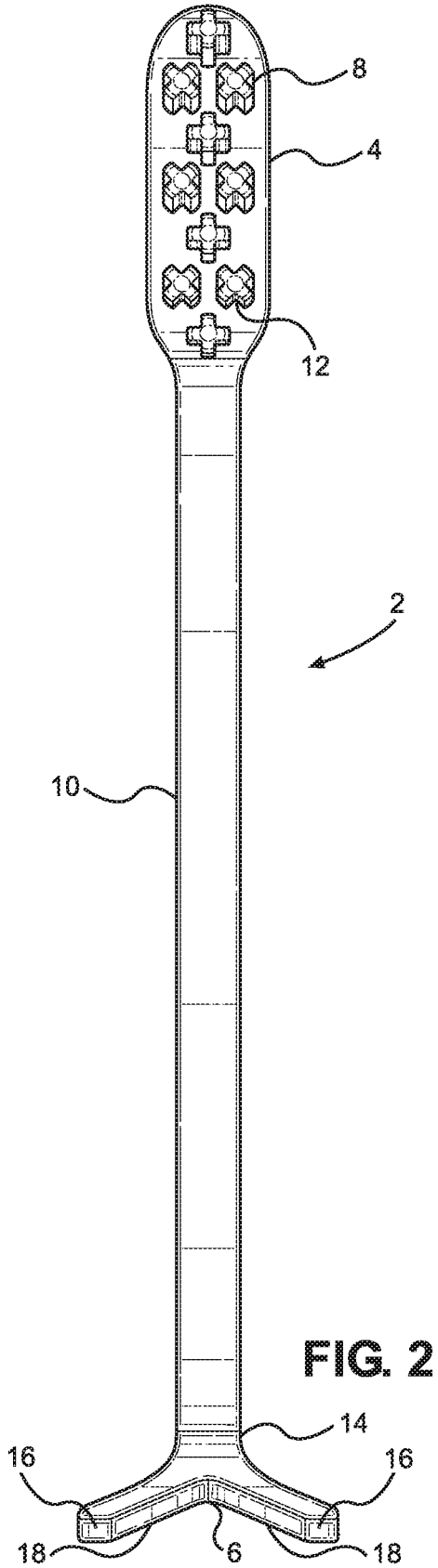
FIG. 2 is a top view of the dental appliance.
Figure 3:
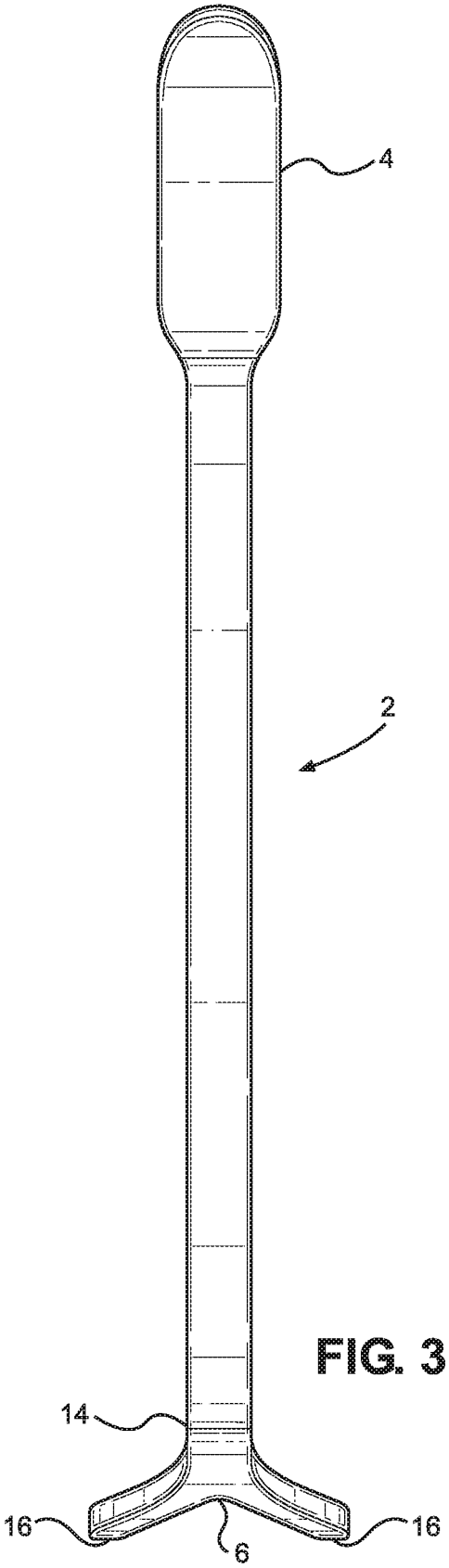
FIG. 3 is a bottom view of the dental appliance.

The invention is directed to a dental appliance that can be used to clean the mouth of a user. In particular, the dental appliance is directed to the removal of adhesives that are used to secure dentures in place in an individual. In most instances, when the dentures are removed a residual quantity of adhesive remains in the gum area and other areas of the mouth of the person wearing the dentures. The residual adhesive can be uncomfortable for the wearer of dentures and the residual adhesive should be removed before the dentures are reinserted with a fresh supply of adhesive. The features of the invention will be more readily understood by referring to the attached drawings in connection with the following description.

As shown in FIGS. 1-7, the dental appliance 1 has the general shape of a toothbrush. The dental appliance has a handle 10 and a body 4 that extends from the handle 10. The body 4 of the dental appliance is designed to readily fit into the mouth of a user and be generally the same size as the end of a toothbrush that extends into the user's mouth. The handle 10 is also designed so that the user can grip the handle and position the dental appliance in the desired location in the user's mouth. It is understood that other body and handle sizes or shapes may be used.

A plurality of cleaning elements 8 extend through the body 4 of the dental appliance 2. The cleaning elements 8 are shown as substantially being cylindrical with a plurality of grooves 12, but it should be appreciated that quantity of grooves on the cleaning elements may be increased or decreased. Further, while the preferred embodiment utilizes cleaning elements of a substantially cylindrical nature, other geometric shapes can be used. It should also be appreciated that the number of cleaning elements 8 in the body 4 can vary from the numbers shown in the figures. In some applications, a single bore may be adequate whereas in other applications considerably more bores than shown in the figures may be desirable.

In the preferred embodiment, the cleaning elements 8 are designed to be semi-rigid to rigid, but is should be appreciated that less rigid cleaning elements 8 may be used in other embodiments of the dental appliance. Further, in the preferred embodiment, the cleaning elements 8, are positioned in rows alternation between one cleaning element and two cleaning elements, it should be appreciated that other patterns of cleaning elements may be used. Further still, in the preferred embodiment the direction cleaning elements 8 alternates from row to row. The direction cleaning elements may be changed for other embodiments.

Figure 4:
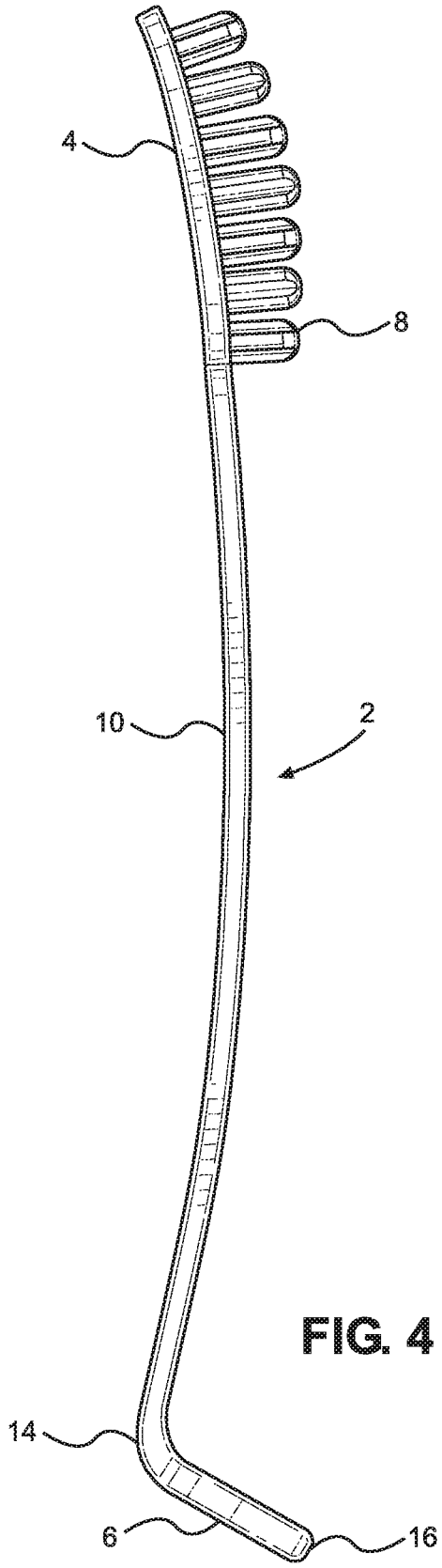
FIG. 4 is an end view of the dental appliance.
Figure 5:
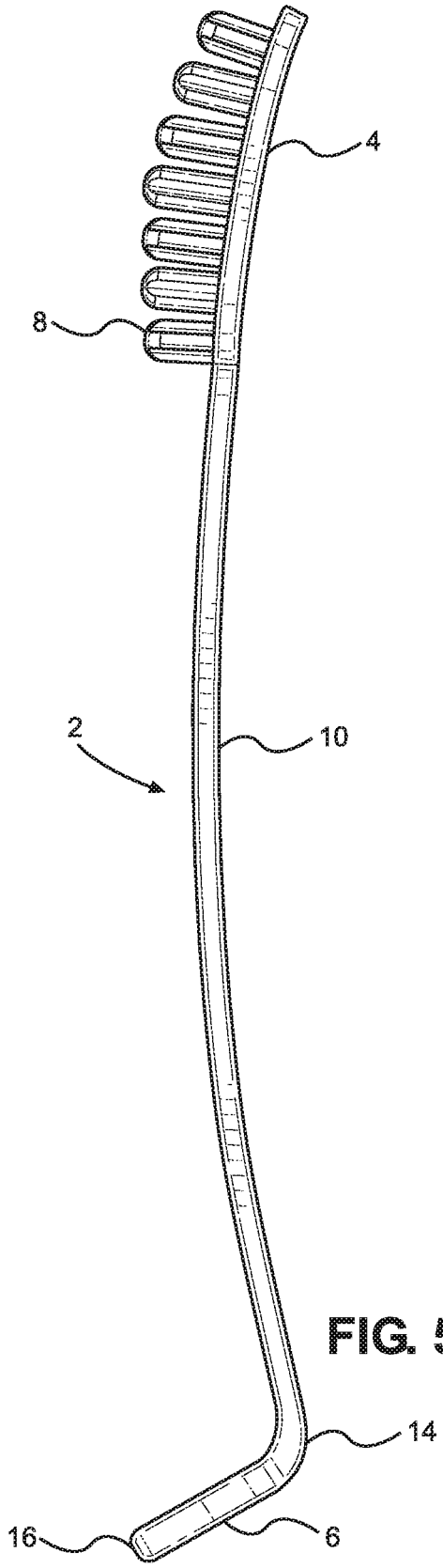
FIG. 5 is a side view of the dental appliance
Figure 6:
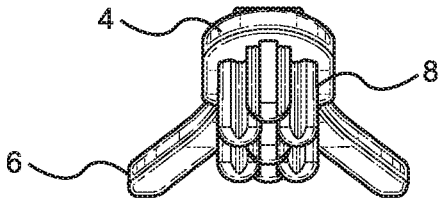
FIG. 6 is a segmented and perspective top view of the dental appliance; and, FIG. 7 is a segmented and perspective bottom view of the dental appliance.
Figure 7:
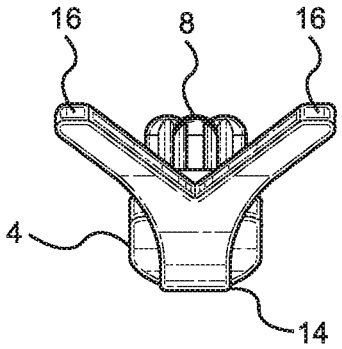

As shown in FIGS. 1 and 4-5, the cleaning elements 8 extends from the body 4. In the preferred embodiment, cleaning elements 8 are fixed to the body 4, but it should be appreciated that a dental appliance 2 may be made with removable/replaceable cleaning elements 8.

The body 4 could also contain at least 1 bristle, such a toothbrush bristle, to assist in removing material from the user's mouth. If bristles are used, there would usually be a plurality of bristles as this is more effective in providing a brushing action that can be utilized to remove material.

The dental appliance 2, having handle 10 wherein the handle is attached to the body 4 on one side and an end 14 on the other side. The end 14 of the handle 10 that is spaced apart from the body 4 has a Y-shaped extension 6 from the handle. The Y-shaped extension is disposed at an angle from about 75° to about 120° with the centerline of the handle. The legs 16 of the Y-shaped extension 6 have a length from about 0.5 inches to about 2 inches and are positioned with an angle from about 45° to about 120° between the legs. The legs of the Y-shaped extension are designed to fit over the gums of a user to assist in removing adhesive material from the gums of the user. The edges 18 of the legs 16 that are in opposed relationship and that are designed to engage the user's gums can have a textured surface that will assist in removing material from the gums. In another embodiment, the legs 16 have additional edges 18, creating different shapes of legs 16, Further, the legs 16 could be other geometric shapes, even cylindrical.

In operation, the user of the dental appliance will grasp the handle 10 and position the body 4 in the mouth area of the user. The cleaning elements 8 will be positioned in the body 4 so that the cleaning elements extend from the body 4. The cleaning elements that extend from the body 9 are then brought into engagement with the material, such as denture adhesive, that is to be removed from the user's mouth. The dental appliance is moved back and forth to engage and remove the material that is to be removed from the mouth of the user. The textured surface of the cleaning elements 8 assist in engaging and removing the desired material. During the removal process, it is possible for the denture adhesive to engage and be retained upon the cleaning elements 8. The denture adhesive may build up on the cleaning elements 8 during this removal process. The plurality of grooves 12, are designed to grab and hold the removed material. This results in a fairly easy system for cleaning the dental appliance.

FIGS. 1, and 4-5 show features of the invention. In these figures only the additional feature will be described in detail. Features that are the same as features previously described will use the same reference numerals for the components of the invention. As shown in these figures, the handle 10 of the dental appliance extends from the body 4 at an angle from about 5° to about 25° with the center line of the body. The angle of the handle 10 allows the user to more easily position the dental appliance along the gum line to remove adhesive material. This angle can be adjusted in other embodiments.

The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A dental appliance consisting of:

a body having a first surface and a second surface, the first and second surfaces being disposed in parallel relationships;

a handle extending from the body, the handle disposed at an angle from 5° to 25° with respect to center line of the body;

wherein an end of the handle that is spaced apart from the body has a Y-shaped extension, the Y-shaped extension being disposed to assist in removing material from a user's mouth;

a plurality of cleaning elements;

the cleaning elements being cylindrical in shape with four equally spaced grooves on each cleaning element; wherein the plurality of cleaning elements are rigid; and wherein the at least one groove is perpendicular to the first and second surfaces.

* * * * *